US007191979B2

(12) United States Patent
Paukov

(10) Patent No.: US 7,191,979 B2
(45) Date of Patent: Mar. 20, 2007

(54) BUNG FOR A PAPER ROLL

(75) Inventor: Ladislav Paukov, Delta (CA)

(73) Assignee: Global Plastics, Surrey (CA)

( * ) Notice: Subject to any disclaimer, the term of this patent is extended or adjusted under 35 U.S.C. 154(b) by 227 days.

(21) Appl. No.: 10/523,109

(22) PCT Filed: Jun. 10, 2003

(86) PCT No.: PCT/CA03/00927

§ 371 (c)(1),
(2), (4) Date: Feb. 3, 2005

(87) PCT Pub. No.: WO03/104125

PCT Pub. Date: Dec. 18, 2003

(65) Prior Publication Data

US 2006/0226279 A1 Oct. 12, 2006

(51) Int. Cl.
*B65H 75/24* (2006.01)

(52) U.S. Cl. ..... 242/578.2; 242/613.5

(58) Field of Classification Search ..... 242/578, 242/578.2, 578.3, 608, 608.2, 608.6, 608.7, 242/609, 609.1, 610.6, 613, 613.4, 613.5
See application file for complete search history.

(56) References Cited

U.S. PATENT DOCUMENTS 1,935,367 A * 11/1933 Lippitt et al. ..... 242/613.5
1,941,495 A * 1/1934 Schoultheis ..... 242/578
3,145,451 A * 8/1964 Christensen ..... 242/613.5
3,438,589 A 4/1969 Jaspersen
3,615,063 A * 10/1971 Bates ..... 242/613.5
4,032,077 A 6/1977 Baselice
5,163,725 A 11/1992 Leweallyn
5,480,106 A * 1/1996 Voissem ..... 242/613.5
5,513,820 A * 5/1996 Meyer ..... 242/613.5
5,683,058 A * 11/1997 Schwarz et al. ..... 242/578.2
5,915,647 A * 6/1999 Van Deurse ..... 242/613.5
6,138,941 A * 10/2000 Miyake ..... 242/613.5

FOREIGN PATENT DOCUMENTS

GB 2362375 A 11/2001

* cited by examiner

*Primary Examiner*—William A. Rivera
(74) *Attorney, Agent, or Firm*—Brian Y. Lee

(57) ABSTRACT

The invention consists of a bung (10) for a paper roll. The bung is comprised of a body (12) and a roll contacting element (14) frangibly coupled to the body. When the bung (10) is inserted into the cylindrical opening of the paper roll, the roll contacting element (14) breaks off from the body (12).

9 Claims, 3 Drawing Sheets

BUNG FOR A PAPER ROLL

FIELD

The invention relates to support elements for rolls of sheet material, specifically to a bung for insertion into the core of a paper roll.

BACKGROUND

In paper dispensers, the roll of paper within the dispenser is supported by a piece called a bung. The bung is inserted into the core of a paper roll and supports the roll within the dispenser while permitting rotation of the roll to dispense paper.

Generally, a bung can be of various shapes and sizes as long as it fulfills the two-fold task of supporting the roll and allowing rotation. Dowels running the length of the paper roll, small stub-like extensions from the sides of the dispenser, and variations of these types have all been used in the past.

It is an object of this invention to provide a bung for a paper roll that is easily inserted into the roll and is meant for use only with a single roll.

It is a further object of this invention to provide a bung that is dimensioned to restrict the types of paper rolls that can be inserted into a dispenser.

SUMMARY

The invention consists of a bung for a paper roll. The bung is comprised of a core and a roll contacting element frangibly coupled to the core. When the bung is inserted into the cylindrical opening of the paper roll, the roll contacting element breaks off from the core.

Preferably, the roll contacting element is comprised of a plurality of flanges, which fold down and partially surround the core. The flanges may include anchor ridges that contact the paper roll when the bung is inserted.

BRIEF DESCRIPTION OF THE DRAWINGS

The invention itself both as to organization and method of operation, as well as additional objects and advantages thereof, will become readily apparent from the following detailed description when read in connection with the accompanying drawings.

DETAILED DESCRIPTION

Figure 1:
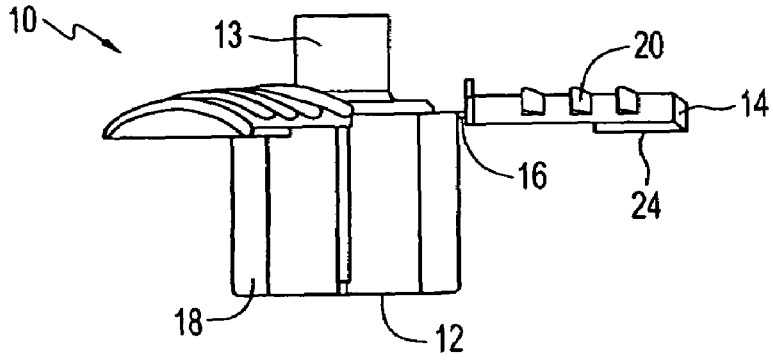
FIG. 1 is a side view of a bung in an unfolded state.
Figure 2:
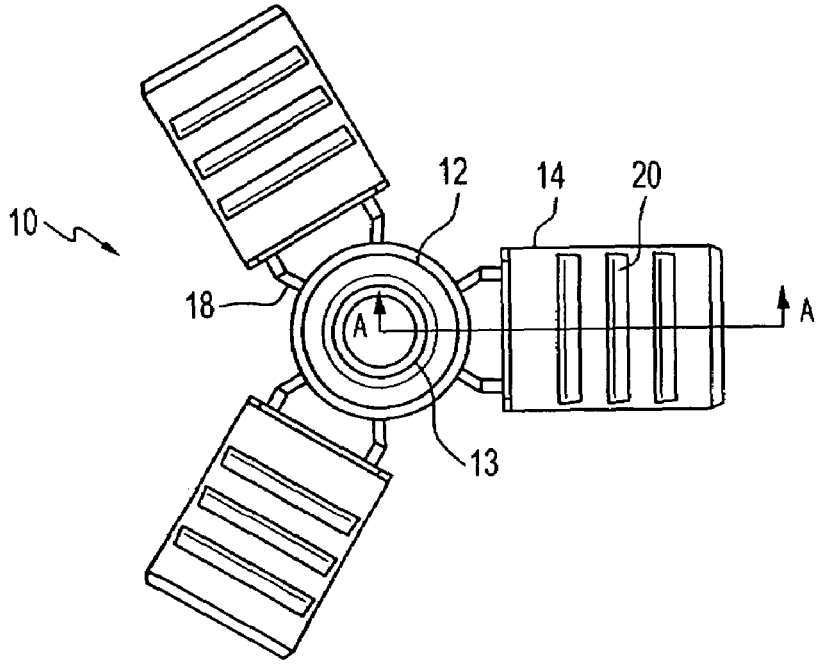
FIG. 2 is a top view of a bung in an unfolded state.
Figure 3:
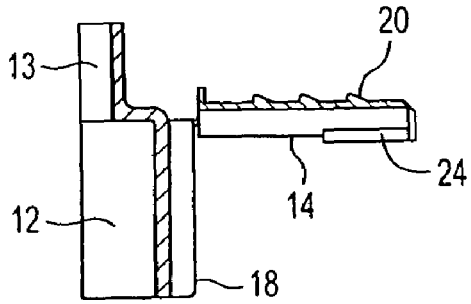
FIG. 3 is a sectional view along line A—A of FIG. 2.
Figure 4:
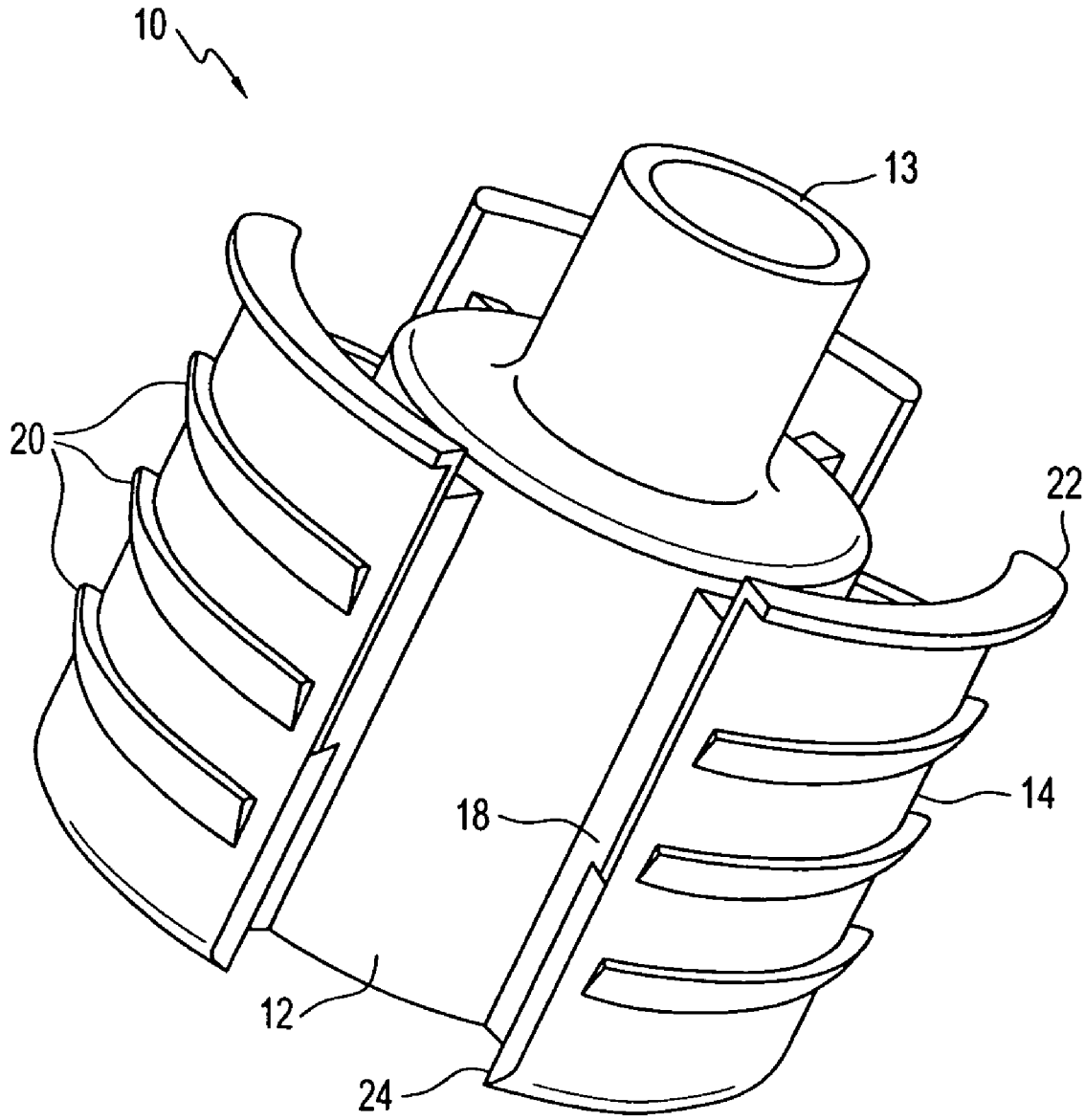
FIG. 4 is a perspective view of a bung in a folded state.

A bung 10 for mounting a roll of paper or a similar material in a dispenser is shown in FIG. 1 in its unfolded (open) state, with additional views shown in FIGS. 2 and 3. The bung 10 consists of a cylindrical core 12 with a number of flanges 14 attached by frangible tabs 16 to the core 12. Each flange 14 has ridges 20 for securing the flange 14 to a paper roll. The core 12 has vertical ridges 18 which abut the lower surface of the flanges 14 when the bung 10 is in a closed position (as shown in FIG. 4). Each flange 14 has a lower lip 24 at the bottom so that a small amount of space is maintained between the ridge 18 and the flange 14 when the bung 10 is in a closed position.

The core 12 has a protruding end 13 that is inserted into a receptacle on the dispenser (not shown) to hold the paper roll within the dispenser. The core 12 and flanges 14 end up fully inserted into the end of the paper roll (see FIG. 5). The flanges 14 are approximately the same length as the core 12.

FIG. 4 shows the bung 10 in its folded (closed) state, ready for insertion into a paper roll. Each flange 14, is folded against the vertical ribs 18, with lower lip 24 directly abutting the ribs 18. The upper edge of the flange 14 is marked by a protruding upper lip 22.

Figure 5:
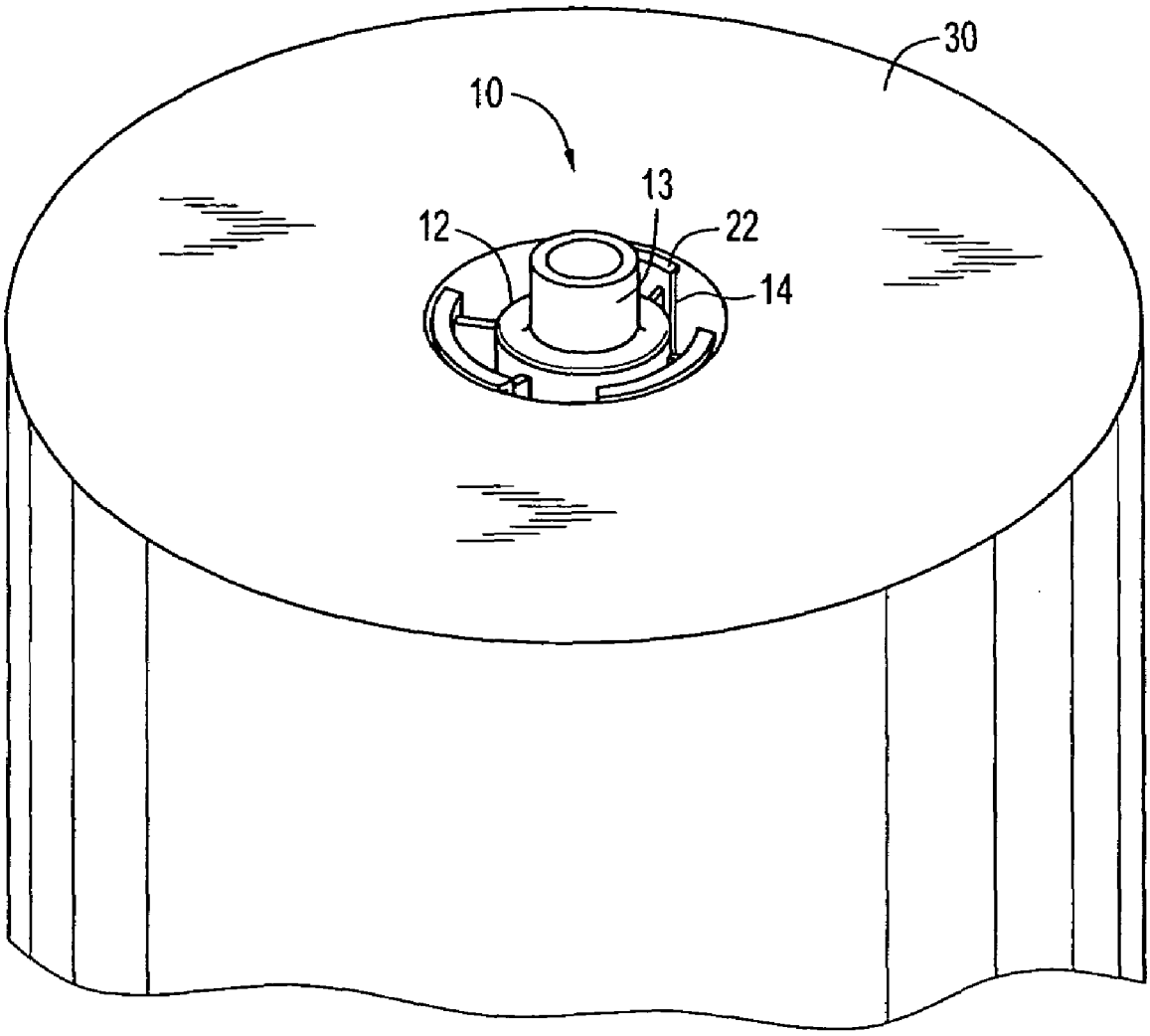
FIG. 5 is a perspective view of a folded bung inserted into a paper roll.

In operation, the bung 10 is inserted into a roll of paper 30 as shown in FIG. 5. First, the flanges 14 are folded down from the open state (FIG. 1) to the closed state (FIG. 4). Once closed, the bung 10 is inserted into the roll of paper 30 until the core 12 is fully within the roll 30. Then, the frangible tabs 16 (as shown in FIG. 1) are broken to detach the core 12 from the flanges 14.

At this point, the bung 10 is fully inserted into the paper roll 30. If core 12 is removed, then the flanges 14 will no longer remain in the paper roll and will fall out. At that point, the bung 10 cannot be reassembled without significant time and effort. As a result, the bung 10 is a single-use item, and must be disposed of (preferably recycled) and a new bung 10 is required for each paper roll 30.

It is most likely that the bung 10 will be inserted into the paper roll 30 at the time of manufacture of the roll 30. If so, the manufacturer can gain an additional advantage by shaping the protruding end 13 of the core 12 of the bung 10 to fit only in a predetermined dispenser. Thus, by designing a dispenser to only accept a corresponding end 13, the manufacturer can limit the types of paper rolls used in the dispenser, as the bung will not fit into a non-compliant dispenser, nor will non-compliant bungs (and paper rolls) fit into a dispenser which is configured for the bung 10.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the scope of the invention.

I claim:

1. A bung for a paper roll having a cylindrical opening, said bung comprising:

(a) a core; and (b) a roll contacting element frangibly coupled to said core such that said roll contacting element breaks from said core when said bung is inserted into said cylindrical opening, said roll contacting element operative to maintain said core in said cylindrical opening.

2. The bung according to claim 1, wherein said roll contacting element is comprised of a plurality of flanges that fold down to partially surround said core.

3. The bung according to claim 2, wherein said plurality of flanges are three in number.

4. The hung according to claim 2, wherein each flange in said plurality of flanges has anchor ridges on an outer surface thereof for contacting an inner cylindrical surface of the cylindrical opening of said paper roll.

5. The hung according to claim 2, wherein each of said plurality of flanges are attached to said body by frangible tabs.

6. The hung according to claim 1, wherein said roll contacting element is operative to hold said body within the cylindrical opening of said paper roll.

7. The hung according to claim 6, wherein said body has a cylindrical-shaped protruding end rotatably couplable to a mounting element on a dispenser.

8. The bang according to claim 6, wherein said plurality of flanges each include a Protruding lip extending outwardly at a first end of said flanges operative to stop said first end from entering further into the cylindrical opening of said paper roll upon insertion of said bung.

9. The bung according to claim 8, wherein said plurality of flanges each include an inner plate extending inwardly at a second end of said flanges operative to contact an edge of a corresponding plate on said cylindrical core to prevent said cylindrical core from traveling too far into said paper roll when said flanges decouple from said cylindrical core.

* * * * *

UNITED STATES PATENT AND TRADEMARK OFFICE

CERTIFICATE OF CORRECTION

PATENT NO. : 7,191,979 B2
APPLICATION NO. : 10/523109
DATED : March 20, 2007
INVENTOR(S) : Ladislav Paukov It is certified that error appears in the above-identified patent and that said Letters Patent is hereby corrected as shown below:

On Title Page column 2, change “9 claims” to --8 claims--.

In claim 4 at column 2 line 61, delete “hung” and replace it with --bung--.

Delete claim 5 at column 2 lines 65 to 67 and replace it with the following:

--5. The bung according to claim 1, wherein said core has a cylindrical protrusion at a first end thereof rotatably couplable to a mounting element on a dispenser.--

Delete claim 6 at column 3 lines 1 to 3 and replace it with the following:

--6. The bung according to claim 2, wherein each of said plurality of flanges is attached to said core by frangible tabs.--

Delete claim 7 at column 3 lines 4 to 6 and replace it with the following:

--7. The bung according to claim 2, wherein said plurality of flanges each includes a protruding lip extending outwardly at a first end of said flanges, said lip operative to stop said first end from entering the cylindrical opening of said paper roll upon insertion of said bung.--

Delete claim 8 at column 3 lines 7 to 11 replace it with the following:

--8. The bung according to claim 7, wherein said plurality of flanges each includes an inner lip extending inwardly at a second end of said flanges operative to engage said core such that said core is prevented from traveling too far into said paper roll when said flanges are broken from said core.--

UNITED STATES PATENT AND TRADEMARK OFFICE

CERTIFICATE OF CORRECTION

PATENT NO. : 7,191,979 B2
APPLICATION NO. : 10/523109
DATED : March 20, 2007
INVENTOR(S) : Ladislav Paukov It is certified that error appears in the above-identified patent and that said Letters Patent is hereby corrected as shown below:

Delete claim 9 at column 4 lines 1 to 6.

Signed and Sealed this

Third Day of July, 2007

JON W. DUDAS
*Director of the United States Patent and Trademark Office*